US006591583B2

(12) United States Patent
Dickey et al.

(10) Patent No.: US 6,591,583 B2
(45) Date of Patent: Jul. 15, 2003

(54) METHOD OF FINISHING SHEET METAL GOODS

(75) Inventors: David M. Dickey, Roseville, CA (US); James J. deBlanc, Roseville, CA (US); George G. Giannini, Granite Bay, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 73 days.

(21) Appl. No.: 09/843,485

(22) Filed: Apr. 25, 2001

(65) Prior Publication Data

US 2002/0157350 A1 Oct. 31, 2002

(51) Int. Cl.[7] ..... B65B 61/02; B65B 53/02
(52) U.S. Cl. ..... 53/411; 53/442; 156/85
(58) Field of Search ..... 53/411, 442, 397, 53/131.4, 131.1, 131.2, 557, 585; 156/85, 277

(56) References Cited

U.S. PATENT DOCUMENTS 2,545,243 A * 3/1951 Rumsey, Jr. ..... 156/85
5,298,824 A * 3/1994 Franz ..... 53/442
5,862,911 A * 1/1999 Phillips et al. ..... 206/497
5,934,461 A * 8/1999 Fleenor et al. ..... 206/524.6
5,962,368 A * 10/1999 Poole ..... 156/277

* cited by examiner

*Primary Examiner*—Stephen F. Gerrity

(57) ABSTRACT

A method of finishing an enclosure formed from sheet metal includes the step of providing a tube formed from a film of a heat shrink polymer. The enclosure is inserted into the tube. Heat is applied to shrink the tube about the enclosure. Another method of finishing the enclosure includes the step of providing a sheet of a heat shrink polymer. The sheet is wrapped about the enclosure. The wrapped sheet may be affixed to the enclosure mechanically, chemically, or some combination thereof. Heat is applied to shrink wrap the sheet about the enclosure. In various embodiments the heat shrink polymer comprises at least one of the following polymers: irradiated low density polyethylene (LDPE), polyolefin, poly-ethylene terephthalate (PET), poly-vinyl chloride (PVC), and fluoropolymers such as poly-tetrafluoroethylene (PTFE), poly-vinylidene di-fluoride (PVDF), fluoroethyl-enepropylene (FEP), and perfluoroalkoxy (PFA).

20 Claims, 3 Drawing Sheets

METHOD OF FINISHING SHEET METAL GOODS

FIELD OF THE INVENTION

This invention relates to the field of manufacturing. In particular, this invention is drawn to finishing sheet metal goods.

BACKGROUND OF THE INVENTION

Computer equipment and other consumer electronics are frequently packaged in sheet metal enclosures. The metal enclosures are typically finished for a variety of reasons including aesthetics and protection for the sheet metal. For example, sheet metal enclosures for computer equipment and peripherals may be finished with a baked enamel finish. Labels are applied to the painted metal enclosures in order to meet manufacturing, legal, or marketing requirements.

Painting and affixing labels to the enclosure introduce non-negligible costs into the manufacturing process. In addition, the use of multiple labels creates additional inventory control, quality control, and material requirements planning issues. Alternative finishing processes to reduce cost or simplify manufacturing are desirable.

SUMMARY OF THE INVENTION

A method of finishing an enclosure includes the step of providing a tube formed from a film of a heat shrink polymer. An enclosure formed from sheet metal is inserted into the tube. Heat is applied to shrink the tube about the enclosure.

Another method of finishing an enclosure includes the step of providing a sheet of a heat shrink polymer. The sheet is wrapped about an enclosure formed from sheet metal. Heat is applied to shrink wrap the sheet about the enclosure.

In various embodiments the heat shrink polymer comprises at least one of the following polymers: irradiated low density polyethylene (LDPE), polyolefin, poly-ethylene terephthalate (PET), poly-vinyl chloride (PVC), and fluoropolymers such as poly-tetrafluoroethylene (PTFE), poly-vinylidene di-fluoride (PVDF), fluoroethylenepropylene (FEP), and perfluoroalkoxy (PFA).

Other features and advantages of the present invention will be apparent from the accompanying drawings and from the detailed description that follows below.

BRIEF DESCRIPTION OF THE DRAWINGS

The present invention is illustrated by way of example and not limitation in the figures of the accompanying drawings, in which like references indicate similar elements and in which.

DETAILED DESCRIPTION

Figure 1:
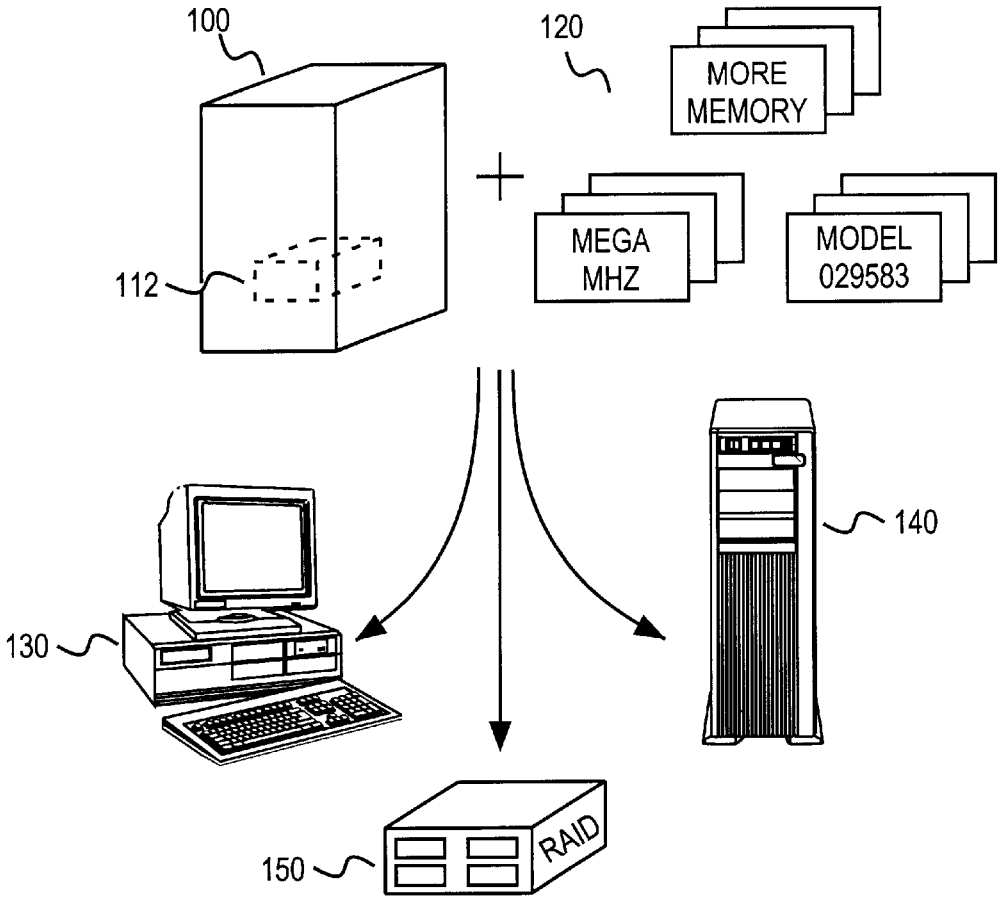
FIG. 1 illustrates a generic metal enclosure formed from stamped sheet metal.

FIG. 1 illustrates a generic metal enclosure 100 formed from sheet metal. One or more pieces of sheet metal are stamped or punched (i.e., die cut) to the appropriate 2-D shape and then bent or folded and combined to form the box-like enclosure 100 for securing components such as 112. Typically one side of the enclosure is formed from another material such as plastic. Component 112 may be at least partially accessible externally (e.g., floppy drive). Alternatively, components such as motherboards may be accessible only by removing some portion of the enclosure.

For computer equipment, the metal enclosure 100 is typically cold rolled steel and may be pre-plated for corrosion protection. The surface of the enclosure requires additional finishing to conceal irregularities in the pre-plating as well as wear marks from tooling. A color paint finish which may include texturing is applied to conceal irregularities and provide additional protection for the surface of the enclosure. Alternatively, the enclosure is fitted with plastic skins. The enclosure may be labeled with a plurality of labels 120 for instructive, marketing, legal, or manufacturing purposes. This style of enclosure is frequently used for computer equipment such as desktop base units 130 or server systems 140. This style of enclosure is also frequently used for computer peripherals such as disk drive arrays 150.

As an alternative to painting, heat shrink material may be used to protect and decorate the metal or plastic surfaces. Heat shrink materials are polymer films that shrink to a smaller size when heated and subsequently maintain the smaller size. Examples of heat shrink polymers include irradiated low density polyethylene (LDPE), polyolefin, poly-ethylene terephthalate (PET), and poly-vinyl chloride (PVC) and fluoropolymers such as poly-tetrafluoroethylene (PTFE), poly-vinylidene di-fluoride (PVDF), fluoroethylenepropylene (FEP), and perfluoroalkoxy (PFA). Heat shrink polymers may be selected for chemical resistance, zero or very low moisture absorption, electrical insulation, abrasion or tear resistance, cushioning, and anti-stick properties.

In order to achieve a desired color, color or tint is injected into the heat shrink polymer film at the time of manufacture. Instead of using adhesive labels, the subject matter of at least some of the labels can be printed directly onto the polymer film. Of course, the printing must be scaled to accommodate the shrinkage.

Figure 2:
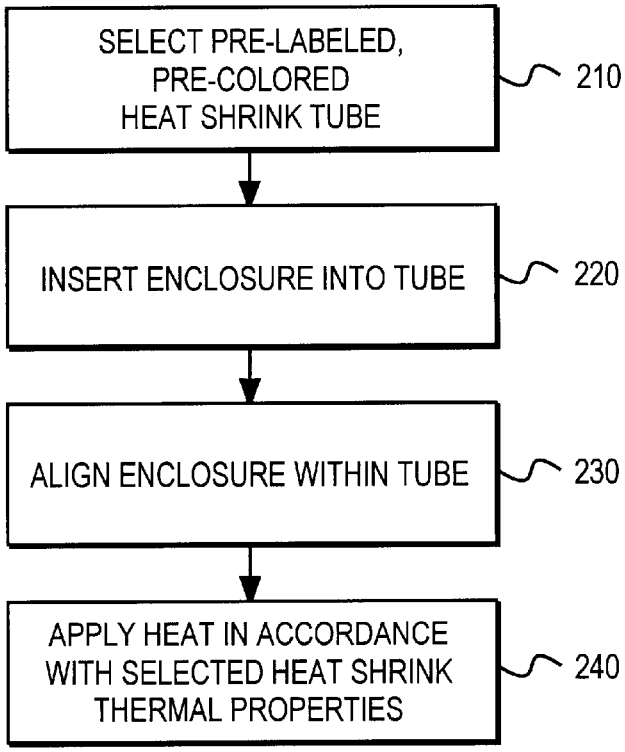
FIG. 2 illustrates one embodiment of a process for finishing a metal enclosure.
Figure 2:
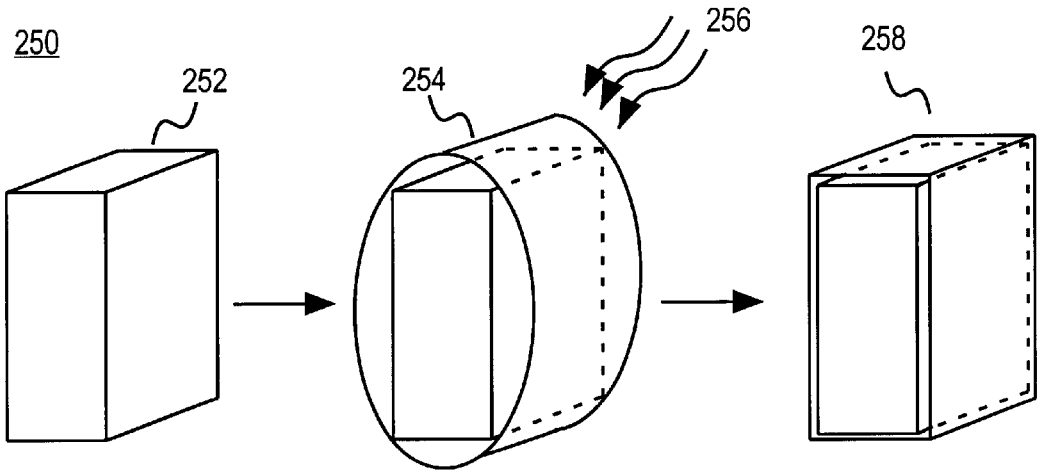

FIG. 2 illustrates one embodiment of a process for finishing a sheet metal enclosure using a heat shrink polymer film. In step 210 a pre-labeled (or pre-printed) and pre-colored heat shrink polymer film in tube form is selected. The enclosure is inserted into the tube in step 220. The enclosure is aligned as necessary relative to the edges of the tube in step 230. Heat is applied in step 240 to shrink the polymer film about the enclosure.

In one embodiment, the heat shrink polymer film is used to finish some but not all sides of the enclosure (e.g., 4 out of the 6). For example, one side may be only partially covered or completely uncovered. The heat shrink material may be pre-cut so that access holes are created in predetermined locations to accommodate features such as air vents or equipment feet or pads.

Some sheet metal enclosures may be prone to rust. Even if the sheet metal has been coated for rust prevention, the edges where the sheet metal has been cut may still be susceptible to rust. Accordingly, in one embodiment, the alignment process ensures that after shrinking the heat shrink material will slightly overlap a sheet metal edge in order to conceal rusting. In one embodiment, the heat shrink material is aligned to overlap one or more sheet metal edges of the enclosure without overlapping any side configured for authorized removal.

The finishing method is graphically illustrated as process 250 beginning with the enclosure 252 which is inserted into the polymer tube. Thermal energy 256 is applied to the tube and enclosure apparatus until a finished enclosure 258 is produced. The finished enclosure is permitted to cool before use.

The required circumference of the tube before the application of heat will depend upon the thermal characteristics of the selected polymer. The polymers can be selected to provide a shrink ratio ranging from about 1.25:1 to 4:1.

Figure 3:
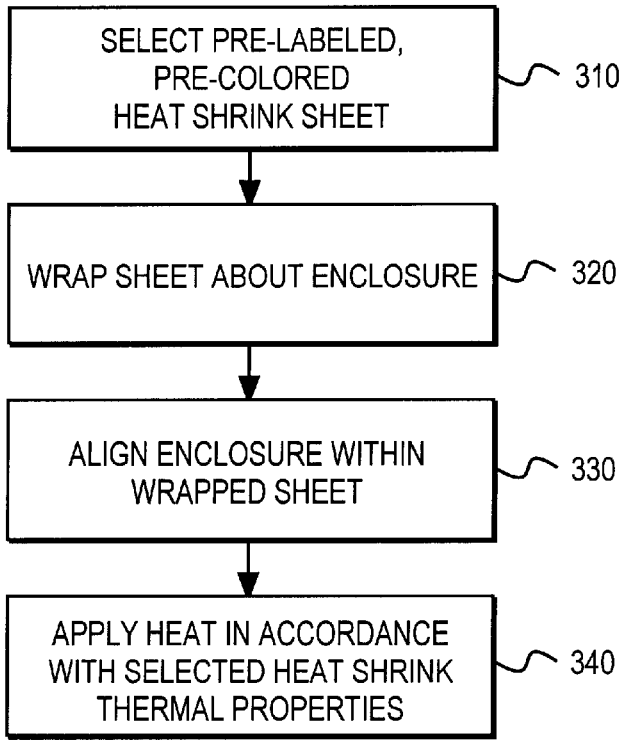
FIG. 3 illustrates an alternative embodiment of a process for finishing a metal enclosure.
Figure 3:
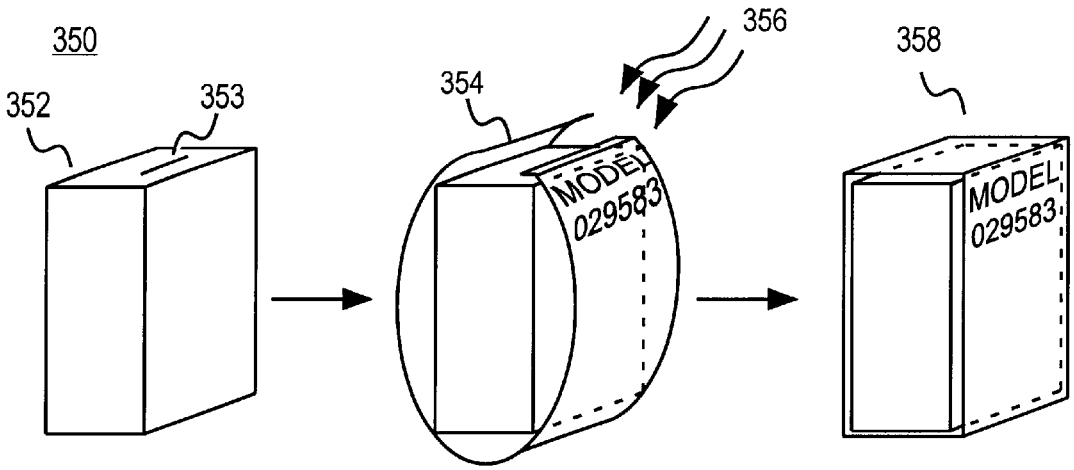

FIG. 3 illustrates an alternative enclosure finishing process. The pre-printed and pre-colored heat shrink polymer film is provided in sheet form rather than tube form in step 310. The sheet is wrapped about the enclosure in step 320. Numerous techniques may be used to wrap the enclosure.

For example, in one embodiment the enclosure is provided with an adhesive to hold or fix one end of the sheet. The free end of the sheet is then wrapped around the enclosure until meeting the opposing fixed end of the sheet. The free end may then be affixed with adhesive or solvent to hold the sheet during the heating process. The solvent permits the sheet to bond to itself.

In an alternative embodiment, a slot or other feature on the enclosure rather than an adhesive is used to fixed one end of the sheet while an opposing end is wrapped around the enclosure. The opposing end is then fixed using an adhesive or solvent or by inserting it into the same or another slot or other feature on the enclosure to hold the sheet during the heating process. Thus the sheet can be affixed to the enclosure by mechanical (e.g., clamping, adhesives) or chemical (solvent) means.

In one embodiment, the sheet is wrapped until it at least partially overlaps itself. During the heating process, the polymer film tends to gel slightly thus reducing or eliminating any variations in thickness due to the overlap.

Once the enclosure is wrapped in heat shrink material, the combination checked if necessary in step 330 to ensure the heat shrink material is properly aligned with the enclosure based on the anticipated shrinkage of the heat shrink material. Heat is applied to the combination thus shrinking the polymer sheet about the enclosure in step 340.

The method is graphically illustrated as process 350 beginning with the enclosure 352 and holding feature or adhesive 353. The free end of the polymer heat shrink sheet 354 is wrapped around the enclosure after affixing one end at 353. After affixing the free end 354, thermal energy 356 is applied to the sheet wrapped enclosure apparatus until a finished enclosure 358 is produced.

In addition to reducing the cost of painting and labeling, the heat shrink can serve as a tamper indicator for proof of actual or attempted unauthorized access. The equipment warranty, for example, may be voided if the heat shrink is not intact. The enclosure may be configured to permit access to some components (e.g., peripherals such as disk drives) from the exposed sides (i.e., the sides not covered by the heat shrink polymer) while access to secure components (e.g., controller boards) is possible only with access to a side underlying the polymer layer. Such enclosure designs require that at least one side of the enclosure is not covered by the heat shrink material so that it can be removed. Access to any side underlying the polymer necessarily results in visibly damaging, tearing, or cutting the film. Accordingly, proprietary or other components may be secured in the enclosure before finishing in a manner that requires access through a finished side in order to access the secured component. The finish inherently serves as evidence of tampering in the event of subsequent access to the secured components. Any components residing within the enclosure before finishing clearly must be capable of withstanding the heating portion of the heat shrink process.

In the preceding detailed description, the invention is described with reference to specific exemplary embodiments thereof. Various modifications and changes may be made thereto without departing from the broader spirit and scope of the invention as set forth in the claims. The specification and drawings are, accordingly, to be regarded in an illustrative rather than a restrictive sense.

What is claimed is:

1. A method of finishing an enclosure, comprising:

a) providing a heat shrink polymer film;

b) providing an enclosure formed from sheet metal, wherein the enclosure includes a vent;

c) securing a component at least partially disposed within the enclosure;

d) covering at least a portion of the enclosure with the heat shrink polymer film without covering the vent; and e) applying heat to shrink the film about the enclosure after securing the component, wherein the component is inaccessible from any enclosure side covered by the heat shrink polymer film.

2. The method of claim 1 wherein the component is at least partially accessible externally from the enclosure.

3. The method of claim 1 wherein the heat shrink polymer film forms a tube, and wherein step e) further comprises covering the portion of the enclosure by inserting the enclosure into the tube.

4. The method of claim 1 wherein the heat shrink polymer film forms a sheet, and wherein step e) further comprises covering the portion of the enclosure by wrapping the sheet about the enclosure.

5. The method of claim 1 wherein the film comprises at least one of the following polymers: irradiated low density polyethylene (LDPE), polyolefin, poly-ethylene terephthalate (PET), and poly-vinyl chloride (PVC).

6. The method of claim 1 wherein the film comprises a fluoropolymer.

7. The method of claim 6 wherein the fluoropolymer comprises at least one of the following polymers: polytetrafluoroethylene (PTFE), poly-vinylidene di-fluoride (PVDF), fluoroethylenepropylene (FEP), and perfluoroalkoxy (PFA).

8. The method of claim 1 wherein the film is pre-colored.

9. The method of claim 1 wherein the film is pre-printed.

10. The method of claim 1 wherein the component is inaccessible externally from the enclosure.

11. A method of finishing an enclosure, comprising:

a) providing a heat shrink polymer film;

b) providing an enclosure formed from sheet metal;

c) securing a computer equipment component disposed at least partially within the enclosure;

d) covering at least a portion of the enclosure with the heat shrink polymer film; and e) applying heat to shrink the film about the enclosure after securing the component within the enclosure, wherein the component is inaccessible from any enclosure side covered by the heat shrink polymer film.

12. The method of claim 11 wherein the electronic component is at least partially accessible externally from the enclosure.

13. The method of claim 11 wherein the heat shrink polymer film forms a tube, and wherein step e) further comprises covering the portion of the enclosure by inserting the enclosure into the tube.

14. The method of claim 11 wherein the heat shrink polymer film forms a sheet, and wherein step e) further comprises covering the portion of the enclosure by wrapping the sheet about the enclosure.

15. The method of claim 11 wherein the film comprises at least one of the following polymers: irradiated low density polyethylene (LDPE), polyolefin, poly-ethylene terephthalate (PET), and poly-vinyl chloride (PVC).

16. The method of claim 11 wherein the film comprises a fluoropolymer.

17. The method of claim 16 wherein the fluoropolymer comprises at least one of the following polymers: polytetrafluoroethylene (PTFE), poly-vinylidene di-fluoride (PVDF), fluoroethylenepropylene (FEP), and perfluoroalkoxy (PFA).

18. The method of claim 11 wherein the film is precolored.

19. The method of claim 11 wherein the film is preprinted.

20. The method of claim 11 wherein the enclosure includes a vent.

* * * * *